US007416094B2

(12) United States Patent
Sokola, Sr.

(10) Patent No.: US 7,416,094 B2
(45) Date of Patent: Aug. 26, 2008

(54) DINNERWARE WITH ATTACHED FIGURE AND DIET REMINDER

(75) Inventor: Leonard R. Sokola, Sr., 136 Gregg Dr., Wilmington, DE (US) 19808

(73) Assignee: Leonard R. Sokola, Sr., Wilmington, DE (US)

( * ) Notice: Subject to any disclaimer, the term of this patent is extended or adjusted under 35 U.S.C. 154(b) by 749 days.

(21) Appl. No.: 10/611,765

(22) Filed: Jul. 1, 2003

(65) Prior Publication Data

US 2005/0000969 A1 Jan. 6, 2005

(51) Int. Cl.
*A47G 19/06* (2006.01)

(52) U.S. Cl. ..... 220/574

(58) Field of Classification Search ..... 220/574, 220/500, 575, 523

See application file for complete search history.

(56) References Cited

U.S. PATENT DOCUMENTS

| | | | | | |
|---|---|---|---|---|---|
| 79,824 | A | * | 7/1868 | Goff et al. | 220/574 |
| 2,689,424 | A | | 9/1954 | Clagett | |
| D241,398 | S | * | 9/1976 | Frucher | D7/582 |
| 4,863,033 | A | * | 9/1989 | Buj | 206/541 |
| 4,932,542 | A | | 6/1990 | Chen et al. | |
| 5,029,700 | A | | 7/1991 | Chen | |
| 5,105,940 | A | | 4/1992 | Chen | |
| 5,269,717 | A | | 12/1993 | Tardif | |
| 5,419,436 | A | | 5/1995 | Powell | |
| D373,930 | S | * | 9/1996 | Gruneisen, III | D7/515 |
| 5,803,306 | A | | 9/1998 | Lewis | |
| D400,403 | S | * | 11/1998 | Brownell | D7/549 |
| D443,176 | S | * | 6/2001 | Strandberg | D7/396.4 |
| 6,296,488 | B1 | * | 10/2001 | Brenkus et al. | 434/127 |

* cited by examiner

*Primary Examiner*—Stephen J. Castellano
(74) *Attorney, Agent, or Firm*—RatnerPrestia

(57) ABSTRACT

A dinnerware article, such as a dish or plate, bearing a raised likeness of a creature connoting obesity. The article also bears a graphical diet reminder, instructing the user regarding healthful amounts and/or types of foods for his/her consumption.

2 Claims, 7 Drawing Sheets

DINNERWARE WITH ATTACHED FIGURE AND DIET REMINDER

FIELD OF THE INVENTION

The invention relates to novelty dinnerware. More particularly, the invention relates to dinnerware comprising an attached three-dimensional figure and a graphical diet reminder.

BACKGROUND OF THE INVENTION

Novelty dinnerware takes many forms, and is commonly produced for the amusement of children, and sometimes adults. Frequently such dinnerware is designed purely for entertainment purposes, and may include images of cartoon characters or other graphics attractive to children. Less common are dinnerware items that have some novelty aspect designed with a serious message and with an adult consumer in mind, or with the intention of instructing a child (or adult) in some serious pursuit.

One of the greatest problems confronting modern society in economically successful countries is obesity. Obesity brings with it the increased potential for serious conditions such as diabetes, cardiovascular disease, and musculoskeletal problems such as lower back pain. In addition, a high-fat diet has been correlated to increased risk of colon cancer, while the consumption of a high-fiber diet is associated with lower risk of this and other medical conditions. One widely read report indicates that there are as many people on the planet who can be considered overweight and/or obese, as there are people who suffer from malnutrition. Another report indicates that in the United States, 55 percent of adults are overweight by international standards, and 23 percent of American adults are considered obese.

Thus, although attempted weight loss is a common behavior, regardless of age, gender, or ethnicity, and weight loss goals are substantial, obesity remains a major public health problem in the United States. There remains a need for effective ways of encouraging proper eating behavior.

SUMMARY OF THE INVENTION

The invention is a dinnerware article adapted to receive food. The article comprises a shallow container with an upper surface having a center, and a lower surface joined to the upper surface at an edge; a raised likeness of a creature affixed to the upper surface; and a graphical diet reminder on the upper surface.

DETAILED DESCRIPTION OF THE INVENTION

The invention will next be illustrated with reference to the figures, wherein the same numbers indicate the same elements in all figures. Such figures are intended to be illustrative rather than limiting and are included herewith to facilitate the explanation of the present invention. The figures are not to scale, and are not intended to serve as engineering drawings.

Figure 1:
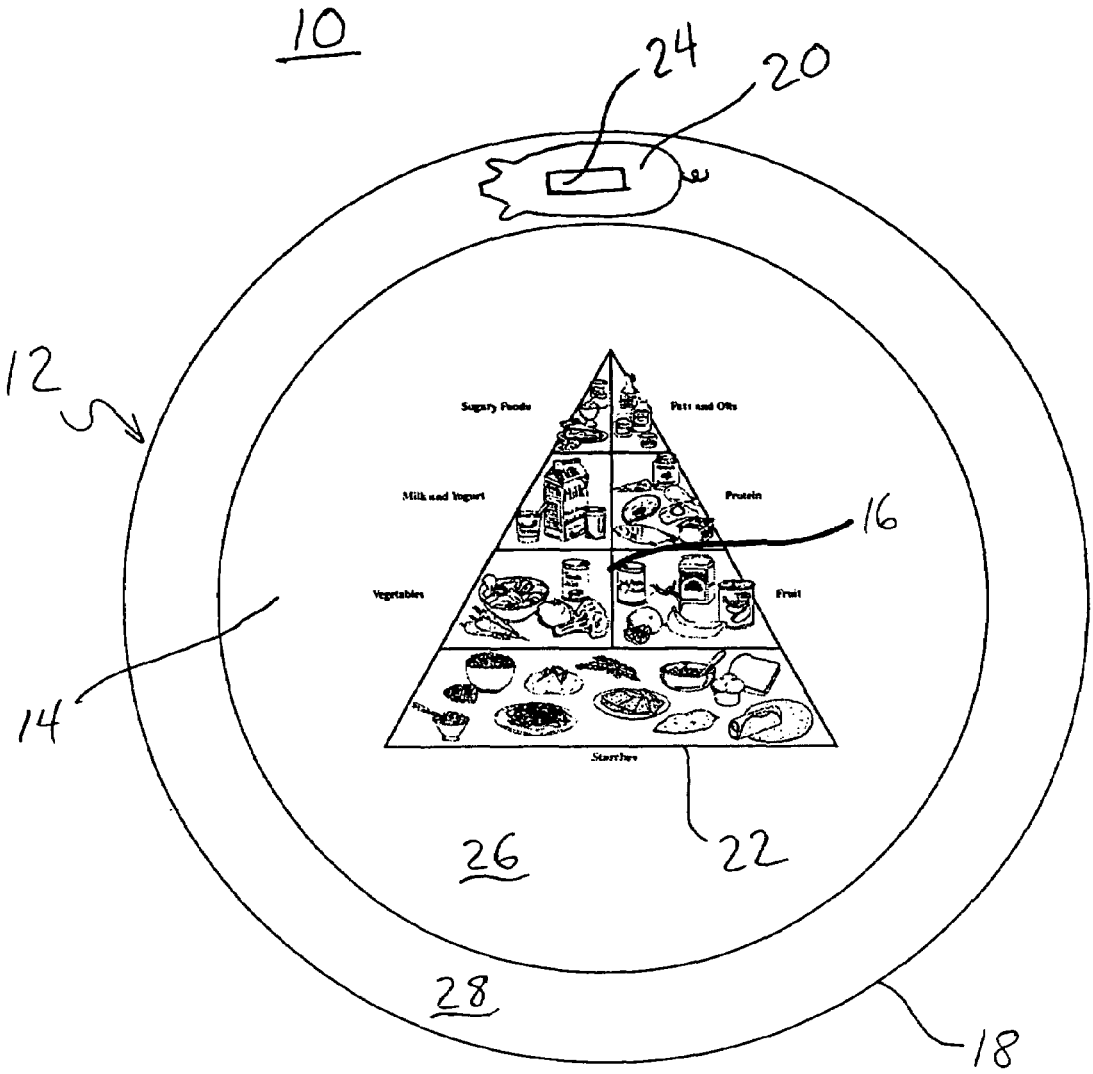
FIG. 1 is a top view of a dinnerware article according to an exemplary embodiment of the invention.

Referring now to FIG. 1, there is shown a top view of a dinnerware article, indicated generally at 10, according to an exemplary embodiment of the invention. The article comprises a shallow container 12 with an upper surface 14, a center 16, and a lower surface 15 (not shown) joined to the upper surface at an edge 18. A raised likeness 20 of a creature is affixed to the upper surface adjacent the edge, and a graphical diet reminder 22 is on the upper surface. In the embodiment shown in FIG. 1, likeness 20 is that of a pig, shown from the top, in which there is an optional hollow space 24 adapted to contain at least one pill. As used herein, the term "pill" is any kind of tablet, capsule, caplet, or the like, including for example vitamins, medications, and candies or mints. The hollow space is shown as rectangular and open at the top in FIG. 1, but it may be closed, and may be of any shape. FIG. 1 shows hollow space 24 as situated in the creature's back, but it may be anywhere on the creature.

Optionally, as shown in FIG. 1, the upper surface 14 comprises a central section 26 and a border section 28 adjacent and surrounding the central section, the border section extending to the edge 18. The border section 28 may be of a different curvature than the central section 26. For example, border section 28 may be only slightly concave, or flat, or even convex, thus forming a rim or lip, while central section 26 might be more strongly concave, or may instead be flat or nearly flat. There are no limitations to the contours of central section 26 and border section 28, provided that shallow container 12 is suitable for receiving food for consumption by a user. By virtue of the presence of a border section 28, a person using the article may be further encouraged to put food only in the central section, thereby reducing serving size. Border section 28 may be of any width, as measured from the edge 18 to central section 26. In one embodiment of the invention, the width of border section 28 is between 10% and 40% of the distance from the edge to the center. It is contemplated that by making the border section larger, and thus the central section smaller, use of the dinnerware article may foster the illusion of a large meal, while in fact encouraging the consumption of smaller portions.

The shallow container 12 may be any commonly used dinnerware article designed for receiving food, and may for example be a saucer, a dish, a bowl, or a plate, such as a dinner, salad, or dessert plate. Shallow container 12 may be of any width, height, and shape. Although the container is shown in FIG. 1 to be circular, it may be oval, rectangular, triangular, or any other regular or irregular shape.

The likeness 20 of a creature is a three-dimensional figure, for example a statuette or a raised relief figure. The term "statuette" is used herein to mean an essentially complete figure. Likeness 20 may be that of any creature. Typically, likeness 20 will be of a creature that connotes obesity, to remind the user of the consequences of unhealthful eating habits. Nonlimiting examples of suitable creatures include a walrus, a hippopotamus, a whale, and an imaginary creature such as for example Jabba the Hutt™. Likeness 20 may be that of an obese person. In one preferred embodiment of the invention, likeness 20 is that of a pig.

The graphical diet reminder 22 is situated on upper surface 14. Typically, it overlies center 16, and is optionally centered on upper surface 14, as shown in FIG. 1. Although FIG. 1 shows diet reminder 22 as being on central section 26, the position of diet reminder 22 can be anywhere on upper surface 14.

Graphical diet reminder 22 may comprise a diagram indicating a breakdown of diet according to food categories. The diagram may include images and/or text relating to different food categories. The food categories may be laid out according to any method of organization, for instance caloric value, fiber content, fat content, vitamin content, protein content, suggested percentages of diet, or any other criteria or combination of criteria. In one exemplary embodiment, graphical diet reminder 22 may be an image of a food pyramid, one version of which is shown in FIG. 1. Instead or in addition, the graphical diet reminder may comprise numerical nutritional information, for example in chart or table format, laying out caloric value, fiber content, and/or other data such as for example outlined above. Graphical diet reminder 22 may also comprise a motivational message in text or other format. One nonlimiting example of a suitable motivational message is "Don't Pig Out!". It is contemplated that, by viewing the graphical diet reminder, the user will be prompted to consume a proper quantity and balance of foods.

Figure 2:
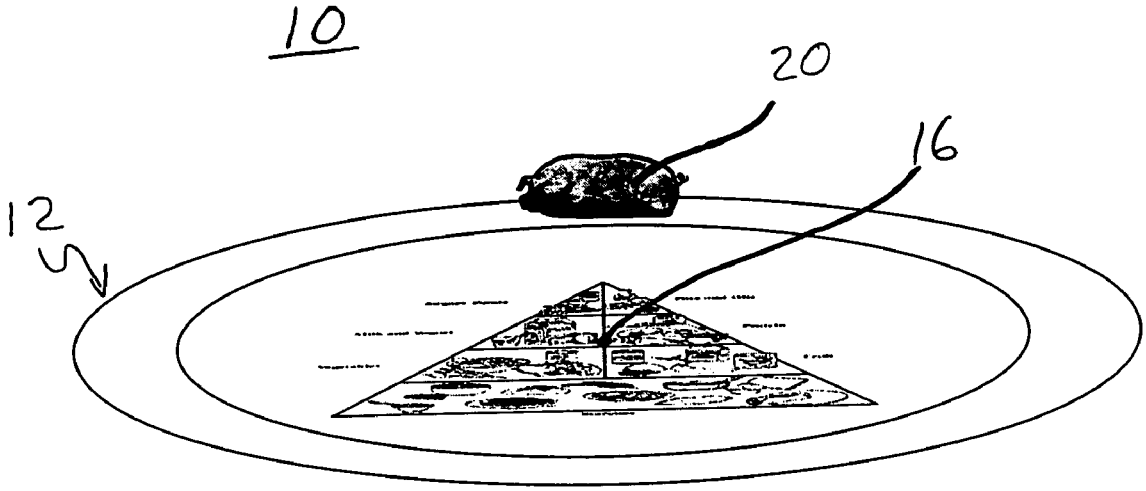
FIG. 2 is a perspective view of the dinnerware article of FIG. 1.

FIG. 2 is a perspective view of the dinnerware article of FIG. 1. In this embodiment of the invention, the likeness 20 of the pig is a statuette of the animal lying on its belly on upper surface 14 of shallow container 12, which in this embodiment is a plate. Alternatively, likeness 20 may be situated so as to appear to be standing upright on upper surface 14, or may appear to be lying on its side or back, or in any other orientation. It may face toward center 16 or away from it, or in any direction. In FIGS. 1 and 2, likeness 20 is permanently affixed to upper surface 14.

Figure 3:
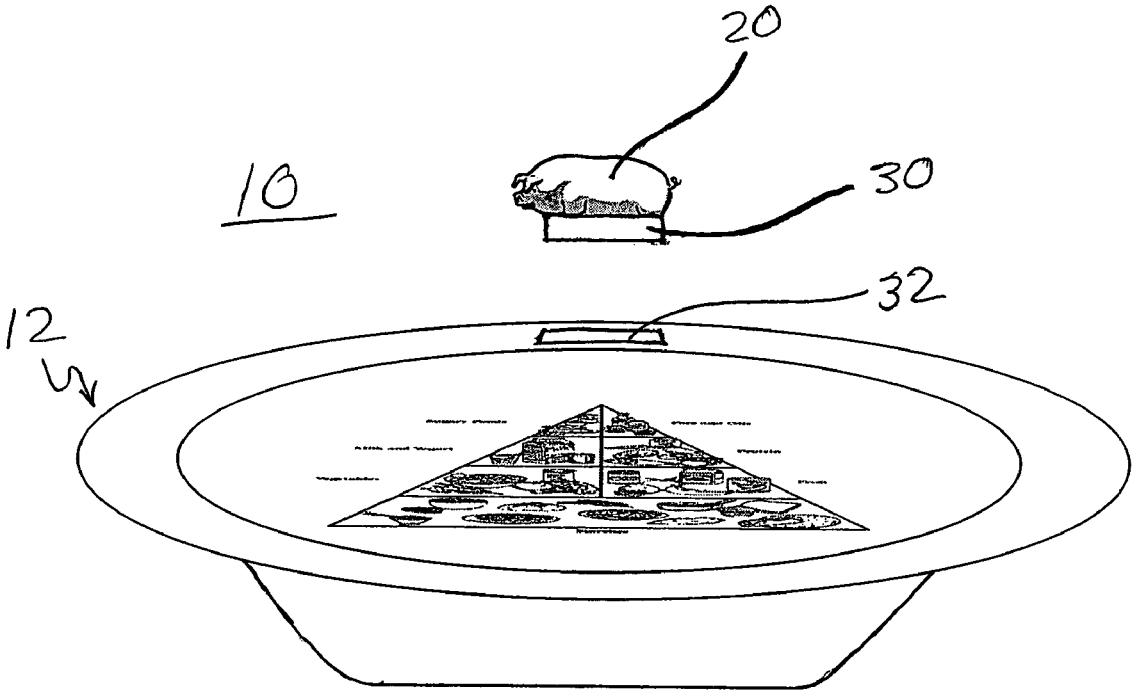
FIG. 3 is a perspective view of a dinnerware article according to another exemplary embodiment of the invention, showing a removably affixed likeness.

FIG. 3 is a perspective view of a dinnerware article according to another exemplary embodiment of the invention in which likeness 20 has attached to it a projection 30 adapted to fit into receiver 32, thereby removably affixing likeness 20 to upper surface 14 of shallow container 12. Projection 30 may be solid or hollow. Although receiver 32 is shown in FIG. 3 as rectangular, it may be of any shape, and may comprise one or both of an indentation and a hole in shallow container 12.

Figure 4:
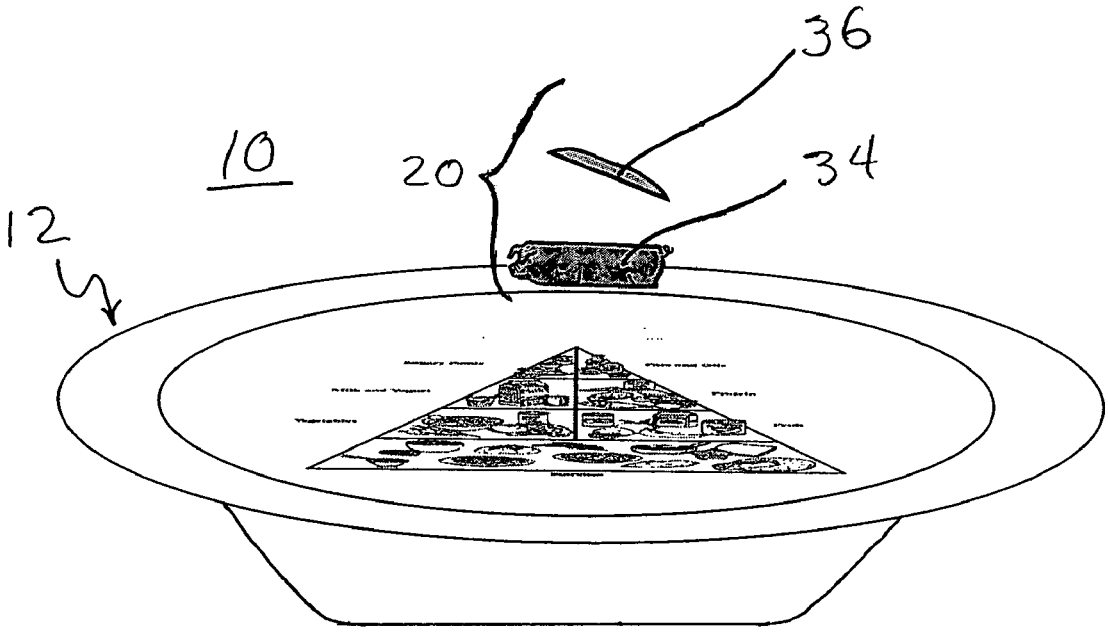
FIG. 4 is a perspective view of a dinnerware article according to yet another exemplary embodiment of the invention, showing a hollow likeness comprising a bottom and a removable top.

FIG. 4 is a perspective view of a dinnerware article according to a further exemplary embodiment of the invention in which likeness 20 is hollow and comprises a bottom 34 and a removable top 36, such that likeness 20 is adapted to contain at least one pill.

Figure 5:
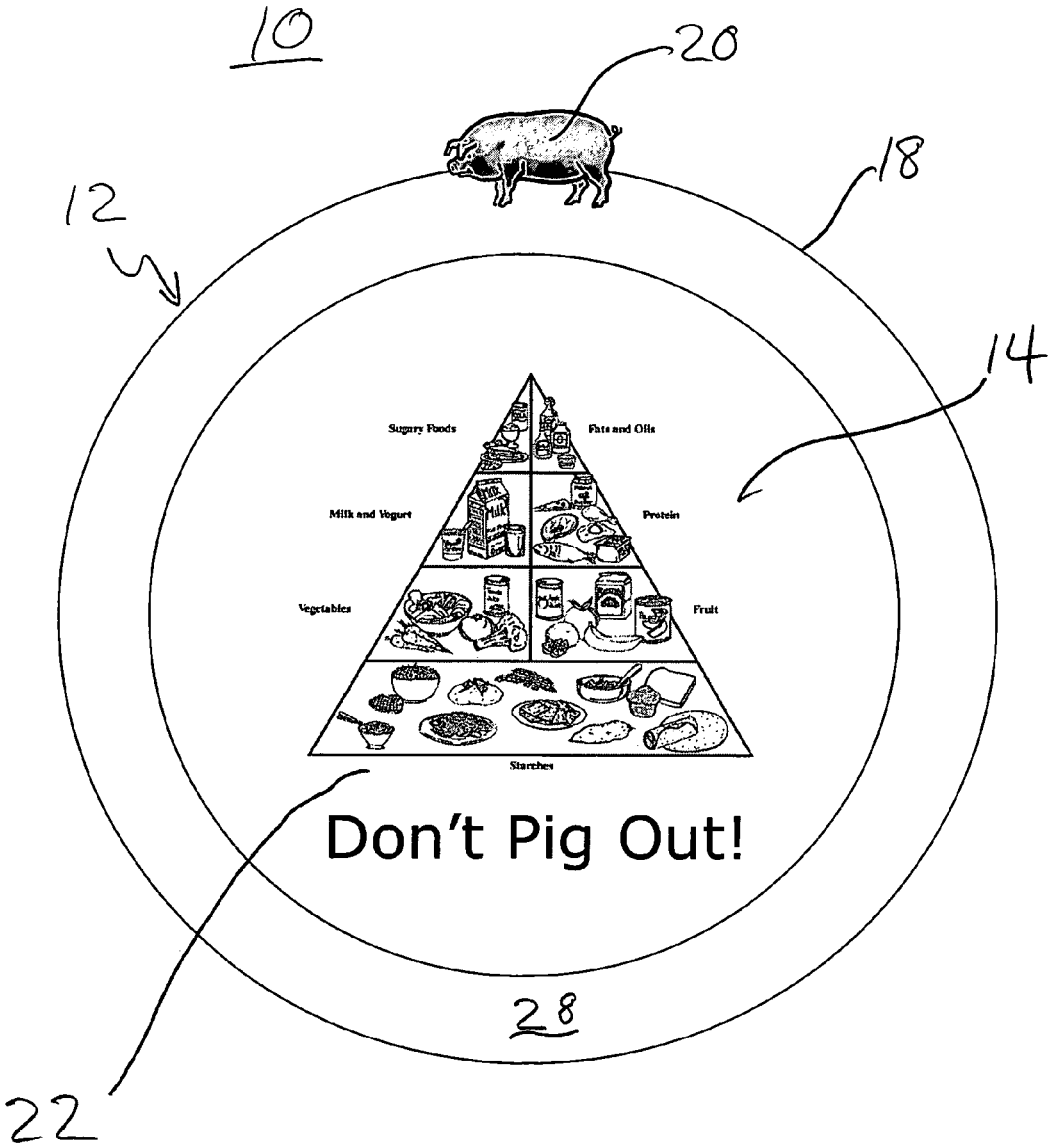
FIG. 5 is a top view of a dinnerware article according to still another exemplary embodiment of the invention, showing a likeness affixed to the upper surface, the edge, and the lower surface of a shallow container.
Figure 6:
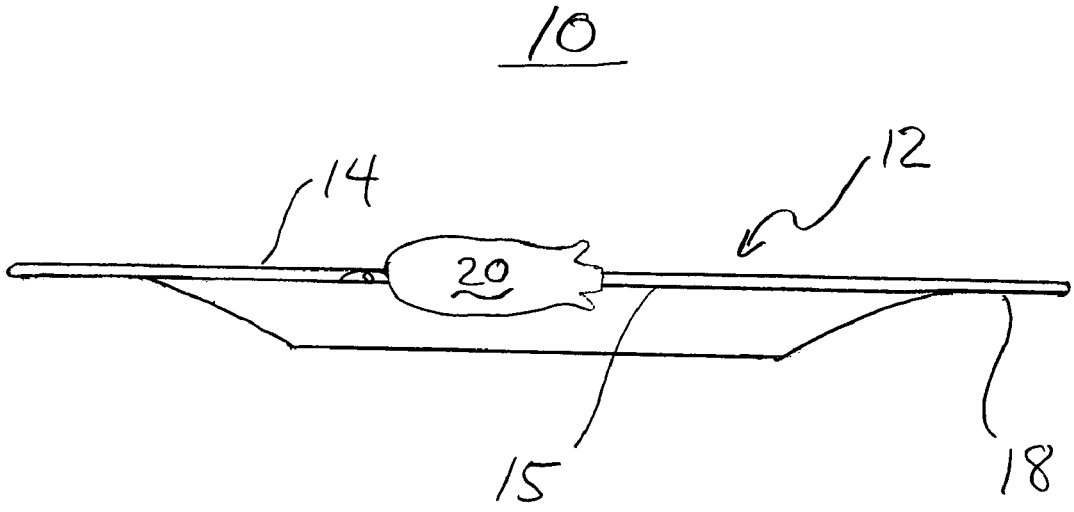
FIG. 6 is a side view of the dinnerware article of FIG. 5.

FIG. 5 shows a top view of a dinnerware article according to still another exemplary embodiment of the invention in which likeness 20 is affixed to the upper surface 14, the edge 18, and the lower surface 15 (hidden from view). Likeness 20 extends laterally from the edge, so that part of the likeness is above upper surface 14 and part of the likeness is below lower surface 15, and may be either permanently or removably affixed. The graphical diet reminder 22 includes a motivational message, "Don't Pig Out!", to encourage the user to keep to his or her diet. FIG. 6 shows the dinnerware article of FIG. 5 as viewed from the side to which the likeness of the pig 20 is attached. Thus the view of the pig in FIG. 6 is of the pig's back, while that shown in FIG. 5 is a full side view of the pig.

Figure 7:
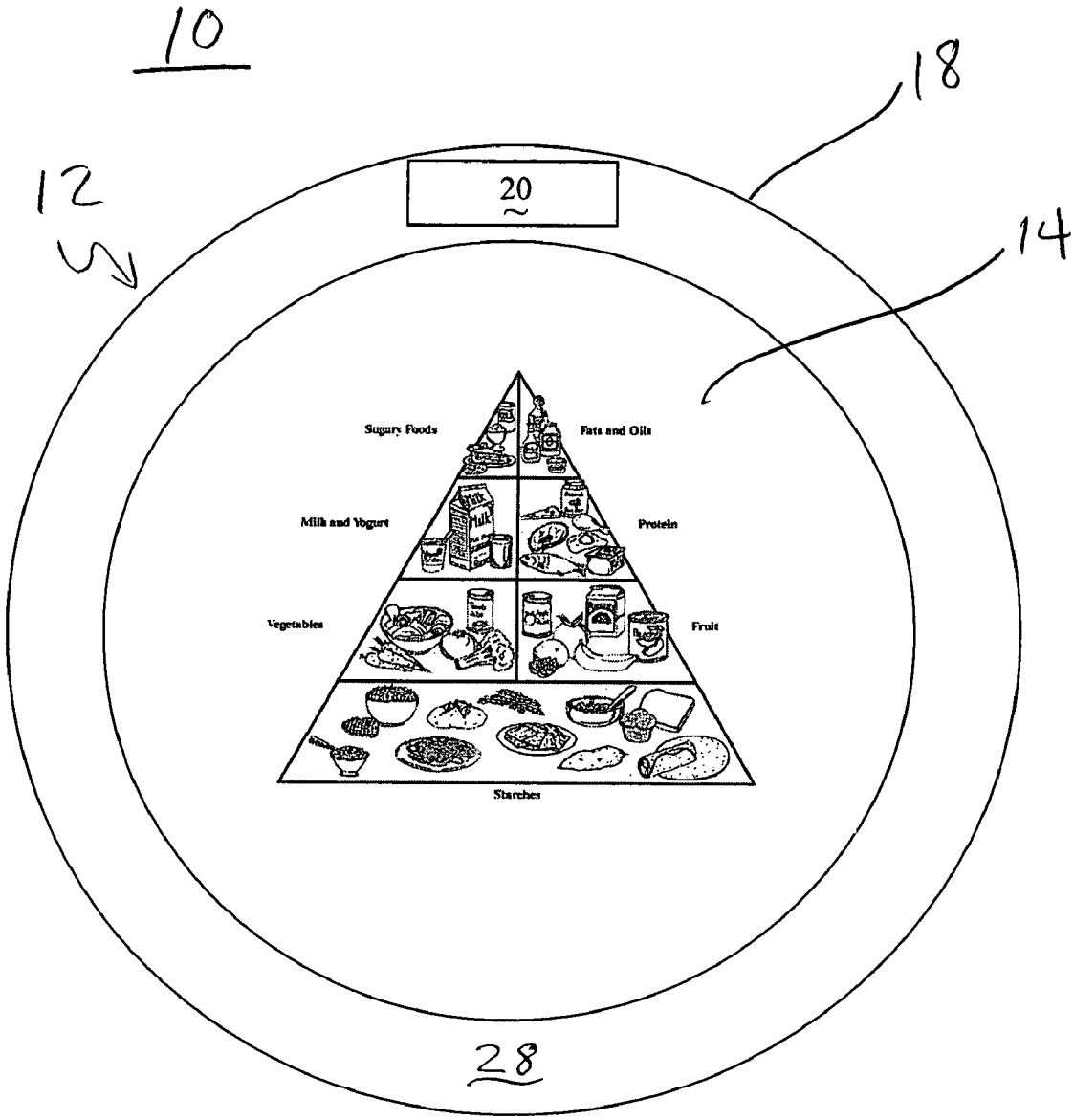
FIG. 7 is top view of a dinnerware article according to the invention in which likeness 20 is indicated generically at the location shown.

FIG. 7 shows a top view of a dinnerware article according to the invention in which likeness 20 is indicated generically at the location shown, on upper surface 14. As noted herein above, likeness 20 may be that of any creature, for example a walrus, a hippopotamus, a whale, an imaginary creature such as Jabba the Hutt™, or an obese person.

By used of a dinnerware article such as described above, it is contemplated that a user will be reminded at mealtime to eat wisely, both in terms of quantity and regarding a healthful balance of food types.

Although the invention is illustrated and described herein with reference to specific embodiments, the invention is not intended to be limited to the details shown. Rather, various modifications may be made in the details within the scope and range of equivalents of the claims and without departing from the invention.

What is claimed:

1. A dinnerware article adapted to receive food, the article comprising:

a shallow container with an upper surface having a center, and a lower surface joined to the upper surface at an edge;

a raised likeness of a creature affixed to the upper surface; and a graphical diet reminder on the upper surface;

wherein the likeness comprises therein a hollow space adapted to contain at least one pill.

2. A dinnerware article adapted to receive food, the article comprising:

a shallow container with an upper surface having a center, and a lower surface joined to the upper surface at an edge;

a raised likeness of a creature affixed to the upper surface; and a graphical diet reminder on the upper surface;

wherein the likeness is hollow and comprises a bottom and a removable top, the likeness adapted to contain at least one pill.

* * * * *